US008578640B1

(12) United States Patent
Krankkala et al.

(10) Patent No.: US 8,578,640 B1
(45) Date of Patent: Nov. 12, 2013

(54) LICENSE PLATE FRAME WITH REMOVABLE ELEMENTS

(75) Inventors: Ken Krankkala, Anthem, AZ (US); Patrick L. Ohm, Mesa, AZ (US); C. Kwai Kong, Gilroy, CA (US)

(73) Assignee: Bell Automotive Products, Inc., Scottsdale, AZ (US)

( * ) Notice: Subject to any disclaimer, the term of this patent is extended or adjusted under 35 U.S.C. 154(b) by 0 days.

(21) Appl. No.: 13/590,557

(22) Filed: Aug. 21, 2012

Related U.S. Application Data

(60) Provisional application No. 61/617,924, filed on Mar. 30, 2012.

(51) Int. Cl.
*G09F 7/00* (2006.01)

(52) U.S. Cl.
USPC ..... 40/209; 40/210; 40/799

(58) Field of Classification Search
USPC ..... 40/209, 210, 729, 799, 730, 798
See application file for complete search history.

(56) References Cited

U.S. PATENT DOCUMENTS

| | | | | |
|---|---|---|---|---|
| 1,498,889 | A * | 6/1924 | Snell | 40/210 |
| 2,869,261 | A | 1/1959 | Audette | |
| 4,043,477 | A * | 8/1977 | Deese | 220/23.4 |
| 4,261,121 | A * | 4/1981 | Coon | 40/332 |
| 4,445,291 | A | 5/1984 | Easley | |
| 4,532,727 | A * | 8/1985 | Klose et al. | 40/729 |
| 4,924,611 | A | 5/1990 | Shaw | |
| D354,727 | S | 1/1995 | Simmons | |
| 6,054,968 | A * | 4/2000 | De Matteo | 312/7.2 |
| 6,347,472 | B1 * | 2/2002 | Dominguez | 40/729 |
| 6,553,695 | B1 | 4/2003 | Wang | |
| 7,350,323 | B1 | 4/2008 | Basos | |
| 8,291,627 | B1 * | 10/2012 | Spencer et al. | 40/209 |
| 2003/0079381 | A1 | 5/2003 | Arens et al. | |
| 2003/0079382 | A1 | 5/2003 | Arens | |
| 2005/0252050 | A1 | 11/2005 | Menke | |
| 2005/0252059 | A1 * | 11/2005 | Marks et al. | 40/799 |
| 2006/0162215 | A1 * | 7/2006 | McVay | 40/799 |
| 2008/0193786 | A1 * | 8/2008 | Morton | 428/542.2 |
| 2010/0132237 | A1 * | 6/2010 | McDermott et al. | 40/633 |
| 2010/0154267 | A1 * | 6/2010 | Nip | 40/799 |
| 2011/0252676 | A1 | 10/2011 | Stringer | |
| 2012/0000104 | A1 * | 1/2012 | Peeters et al. | 40/541 |

* cited by examiner

*Primary Examiner* — Joanne Silbermann
*Assistant Examiner* — Shin Kim
(74) *Attorney, Agent, or Firm* — Booth Udall Fuller, PLC

(57) ABSTRACT

A license plate frame that allows for removable coupling of elements to the license plate frame. The license plate frame may include four borders that each include an outer frame lip and an inner frame lip extending outwardly from a rear surface of the license plate frame. The inner frame lip may include a plurality of equally sized notches adjacent one another. A removable element that includes a pin and a channel is removably coupled to the license plate frame by placing the pin within one of the plurality of notches and placing a portion of the outer frame lip within the channel of the removable element. The removable element may be moved by lifting the pin out of the notch and sliding the outer frame lip through the channel of the removable element before inserting the pin into a different notch.

13 Claims, 5 Drawing Sheets

LICENSE PLATE FRAME WITH REMOVABLE ELEMENTS

CROSS REFERENCE TO RELATED APPLICATIONS

This document claims the benefit of the filing date of U.S. Provisional Patent Application 61/617,924, entitled "LICENSE PLATE WITH REMOVABLE ELEMENTS" to Ohm, which was filed on Mar. 30, 2012, the contents of which are hereby incorporated by reference.

BACKGROUND

1. Technical Field

Aspects of this document relate generally to license plate frames.

2. Background Art

License plate frames allow individuals to add a personal touch to an otherwise uniform vehicle. While numerous license plate frames are available to consumers, license plate frames are not typically manufactured to allow a user to customize or personalize the license plate frame beyond the selection of a particular fixed design on the license plate frame.

SUMMARY

According to an implementation, A license plate frame may comprise four borders surrounding a license plate opening, the four borders comprising a front side and a rear side opposite the front side, an outer frame lip extending outwardly from the rear side of at least one of the four borders, and an inner frame lip extending outwardly from the rear side of at least one of the four borders, the inner frame lip comprising a plurality of equally sized notches adjacent each other within the inner frame lip, each notch sized to fit a pin of a removable element within the notch.

Particular implementations and embodiments may comprise one or more of the following. The inner frame lip extending outwardly from the at least one of the four borders may comprise an inner frame lip extending outwardly from at least two opposing borders of the four borders, and wherein the outer frame lip extending outwardly from the at least one of four borders comprises an outer frame lip extending outwardly from at least two opposing borders of the four borders. The inner frame lip extending outwardly from at least two opposing borders of the four borders may comprise an inner frame lip extending outwardly from each of the four borders, and wherein the outer frame lip extending outwardly from at least two opposing border of the four borders comprises an outer frame lip extending outwardly from each of the four borders. The inner frame lip and the outer frame lip may extend outward substantially perpendicular from the rear side of the borders. The inner frame lip may extends from the four borders at an inner border of the four borders and the outer frame lip extends from the four borders at an outer border of the four borders. The plurality of notches may comprise a plurality of rounded U-shaped notches. The plurality of notches may comprise a plurality of V-shaped notches. At least one removable element may be removably coupled to one of the four borders. The removable element may comprise an L-shaped element comprising a base member coupled to a body member to form an outer surface that covers a portion of the front side of the one of the four borders and an inner surface on the L-shaped member, a channel wall coupled to the base member on an end of the base member opposite the body member to form a channel that houses the outer frame lip of the one of the four borders between the channel wall and the base member, the channel proximate the inside surface of the L-shaped member, and a pin element coupled to the inside surface of the body member and located within one of the plurality of notches. The pin element may be coupled to an inner surface of a head member coupled to the inner surface of the body member, wherein the head member is substantially parallel to the base member and the pin element is substantially parallel to the body member. The body member may extend beyond at least one of the base member and the head member. An ornamental element may be coupled to the outer surface of the body member.

According to an implementation, a removable element for a license plate frame may comprising an L-shaped element comprising a base member coupled to a body member to form an outer surface and an inner surface on the L-shaped member, a channel wall coupled to the base member on an end of the base member opposite the body member to form a channel between the channel wall and the base member, the channel proximate the inside surface of the L-shaped member, and a pin element coupled to the inside surface of the body member.

Particular implementations and embodiments may comprise one or more of the following. The pin element may be coupled to an inner surface of a head member coupled to the inner surface of the body member and wherein the head member is substantially parallel to the base member and the pin element is substantially parallel to the body member. The body member may extends beyond at least one of the base member and the head member. The channel wall may comprise two substantially perpendicular walls. An ornamental element may be coupled to the outer surface of the body member. The outer surface of the body member may comprise an ornamental design.

According to an implementation, a license plate frame may comprise a top border member comprising a front side, a rear side opposite the front side, and two screw mounts, a bottom border member comprising a front side, a rear side opposite the front side, and two screw mounts, an outer frame lip extending outwardly from the rear side of each of the top and bottom border members, an inner frame lip extending outwardly from the rear side of each of the top and bottom border members, the inner frame lip comprising a plurality of equally sized notches adjacent each other within the inner frame lip, each notch sized to fit a pin of a removable element within the notch, and at least one removable element removably coupled one of the top and bottom border members, the removable element comprising a pin protruding from a head member and engaged with one of the plurality of notches, a body member coupled to the head member, and a base member coupled to the body member, the base member comprising a channel slidably engaged with the outer frame lip.

Particular implementations and embodiments may comprise one or more of the following. Two side border members coupled to the top and bottom border members between the top and bottom border members, each side border member comprising an outer frame lip extending outwardly from the rear side of each of the top and bottom border members and an inner frame lip extending outwardly from the rear side of each of the top and bottom border members, the inner frame lip of each side border member comprising a plurality of equally sized notches adjacent each other within the inner frame lip, each notch sized to fit a pin of a removable element within the notch. An ornamental element may be coupled to an outer surface of the body member.

Aspects and applications of the disclosure presented here are described below in the drawings and detailed description.

Unless specifically noted, it is intended that the words and phrases in the specification and the claims be given their plain, ordinary, and accustomed meaning to those of ordinary skill in the applicable arts. The inventors are fully aware that they can be their own lexicographers if desired. The inventors expressly elect, as their own lexicographers, to use only the plain and ordinary meaning of terms in the specification and claims unless they clearly state otherwise and then further, expressly set forth the "special" definition of that term and explain how it differs from the plain and ordinary meaning. Absent such clear statements of intent to apply a "special" definition, it is the inventors' intent and desire that the simple, plain and ordinary meaning to the terms be applied to the interpretation of the specification and claims.

The inventors are also aware of the normal precepts of English grammar. Thus, if a noun, term, or phrase is intended to be further characterized, specified, or narrowed in some way, then such noun, term, or phrase will expressly include additional adjectives, descriptive terms, or other modifiers in accordance with the normal precepts of English grammar. Absent the use of such adjectives, descriptive terms, or modifiers, it is the intent that such nouns, terms, or phrases be given their plain, and ordinary English meaning to those skilled in the applicable arts as set forth above.

Further, the inventors are fully informed of the standards and application of the special provisions of 35 U.S.C. §112, ¶ 6. Thus, the use of the words "function," "means" or "step" in the Detailed Description or Description of the Drawings or claims is not intended to somehow indicate a desire to invoke the special provisions of 35 U.S.C. §112, ¶ 6, to define the invention. To the contrary, if the provisions of 35 U.S.C. §112, ¶ 6 are sought to be invoked to define the inventions, the claims will specifically and expressly state the exact phrases "means for" or "step for, and will also recite the word "function" (i.e., will state "means for performing the function of [insert function]"), without also reciting in such phrases any structure, material or act in support of the function. Thus, even when the claims recite a "means for performing the function of . . . " or "step for performing the function of . . . ," if the claims also recite any structure, material or acts in support of that means or step, or that perform the recited function, then it is the clear intention of the inventors not to invoke the provisions of 35 U.S.C. §112, ¶ 6. Moreover, even if the provisions of 35 U.S.C. §112, ¶ 6 are invoked to define the claimed aspects, it is intended that these aspects not be limited only to the specific structure, material or acts that are described in the preferred embodiments, but in addition, include any and all structures, materials or acts that perform the claimed function as described in alternative embodiments or forms of the disclosure, or that are well known present or later-developed, equivalent structures, material or acts for performing the claimed function.

The foregoing and other aspects, features, and advantages will be apparent to those artisans of ordinary skill in the art from the DESCRIPTION and DRAWINGS, and from the CLAIMS.

BRIEF DESCRIPTION OF THE DRAWINGS

The inventions will hereinafter be described in conjunction with the appended drawings, where like designations denote like elements, and.

DESCRIPTION

Figure 1:
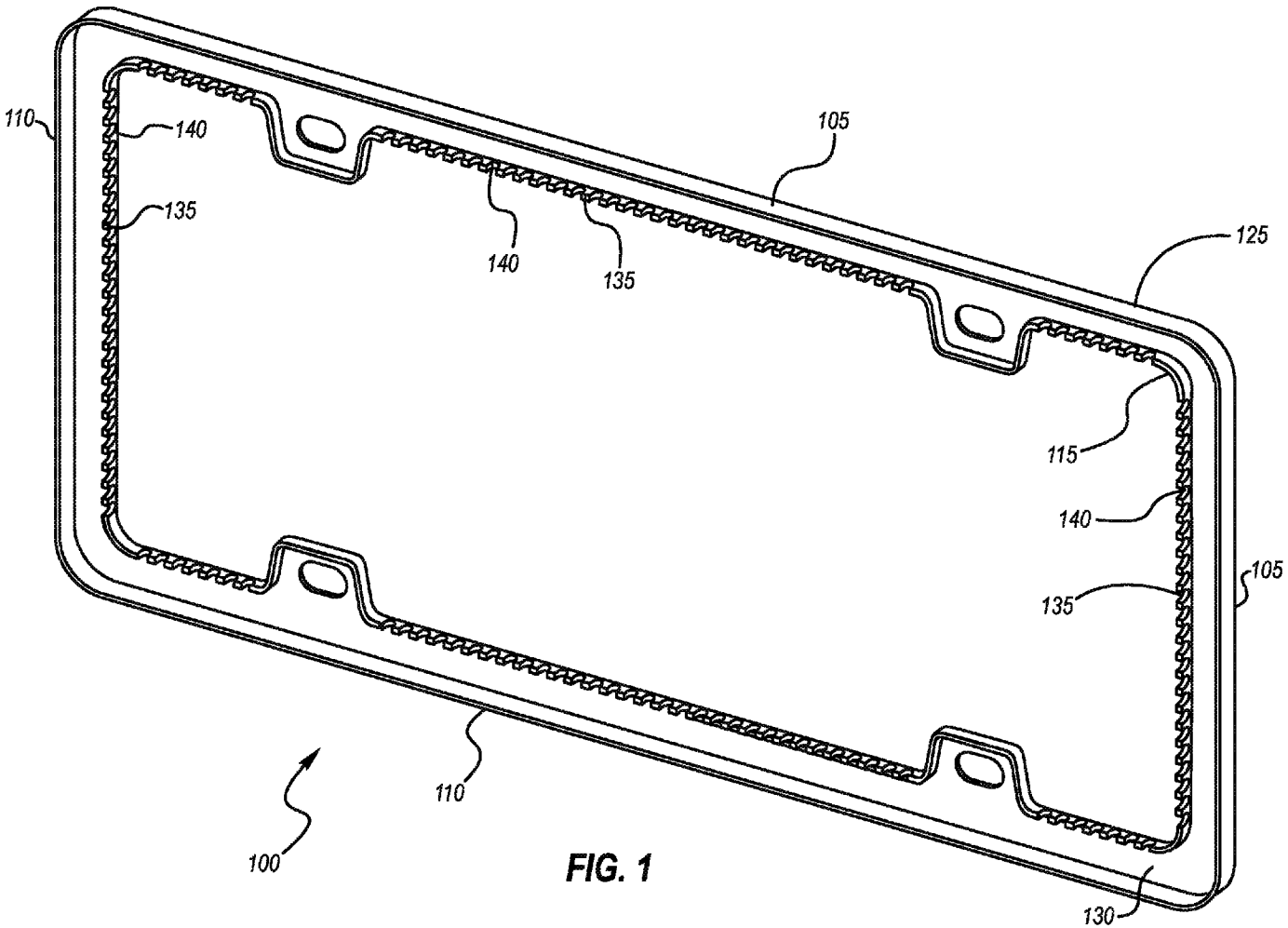
FIG. 1 is a rear perspective view of a license plate frame.

Aspects and applications of the disclosure presented here are described below in the drawings and detailed description. Unless specifically noted, it is intended that the words and phrases in the specification be given their plain, ordinary, and accustomed meaning to those of ordinary skill in the applicable arts. The inventors are fully aware that they can be their own lexicographers if desired. The inventors expressly elect, as their own lexicographers, to use only the plain and ordinary meaning of terms in the specification and claims unless they clearly state otherwise and then further, expressly set forth the "special" definition of that term and explain how it differs from the plain and ordinary meaning. Absent such clear statements of intent to apply a "special" definition, it is the inventors' intent and desire that the simple, plain and ordinary meaning to the terms be applied to the interpretation of the specification and claims.

The inventors are also aware of the normal precepts of English grammar. Thus, if a noun, term, or phrase is intended to be further characterized, specified, or narrowed in some way, then such noun, term, or phrase will expressly include additional adjectives, descriptive terms, or other modifiers in accordance with the normal precepts of English grammar. Absent the use of such adjectives, descriptive terms, or modifiers, it is the intent that such nouns, terms, or phrases be given their plain, and ordinary English meaning to those skilled in the applicable arts as set forth above.

This disclosure, its aspects and implementations, are not limited to the specific components or assembly procedures disclosed herein. Many additional components and assembly procedures known in the art consistent with the intended license plate frames and removable elements and/or assembly procedures for a license plate frames and removable elements will become apparent for use with implementations of license plate frames and removable elements from this disclosure. Accordingly, for example, although particular license plate frames, notches, and removable elements are disclosed, such license plate frames, notches, and removable elements and implementing components may comprise any shape, size, style, type, model, version, measurement, concentration, material, quantity, and/or the like as is known in the art for such license plate frames, notches, and removable elements and implementing components, consistent with the intended operation of license plate frames, notches, and removable elements.

Various implementations of a license plate frames disclosed herein allow a user to customize a license plate frame multiple times after purchase or acquisition of the license plate frame. In a particular implementation, a customized license plate system comprising removable elements coupled to a license plate frame is disclosed. In other implementations, a license plate frame and a removable element configured to be coupled to one another are disclosed.

FIG. 1 illustrates a rear perspective view of a license plate frame 100. In an implementation, a license plate frame comprises four side walls 100 surrounding an opening. At least one of the four side walls 100 may comprise an inner frame edge lip 115 that defines at least a portion of the opening and an outer frame edge lip 110 opposite the inner frame edge 115. Typically, the outer frame edge 110 and inner frame edge extend outwardly from a rear surface 130 of a license plate frame 100. In the implementation shown in FIG. 1, all of the four side walls 105 comprise an inner frame edge 115 and an outer frame edge 110. In other implementations, any number of side walls 105 may comprise an inner frame edge 115 and an outer frame edge 110.

As further illustrated in FIG. 1, at least one of the inner frame edges 115 may comprise one or more notches 140. In the implementation shown in FIG. 1, each of the four inner frame edges comprises a plurality of notches 140. The notches may be uniform in size, dimension, and or configuration through the license plate frame. Alternatively, the plurality of notches may vary on each side or from notch to notch. The notches may comprise a variety of shapes or configurations, such as but not limited to rounded, square, or otherwise angled. In the implementation shown in FIG. 1, the notches 140 comprise rounded notches 140, though rounded notch shapes are not a requirement of the disclosure. The rounded notches may be rounded at either or both the notch peak 135 and valley.

The license plate frame of FIG. 1 further comprises four screw mounts 120 for coupling the license plate frame to a vehicle or any other surface. In other implementations, any of a variety of configurations known in the art may be utilized with the license plate frame 100 to couple the license plate frame 100 to a surface.

Figure 2:
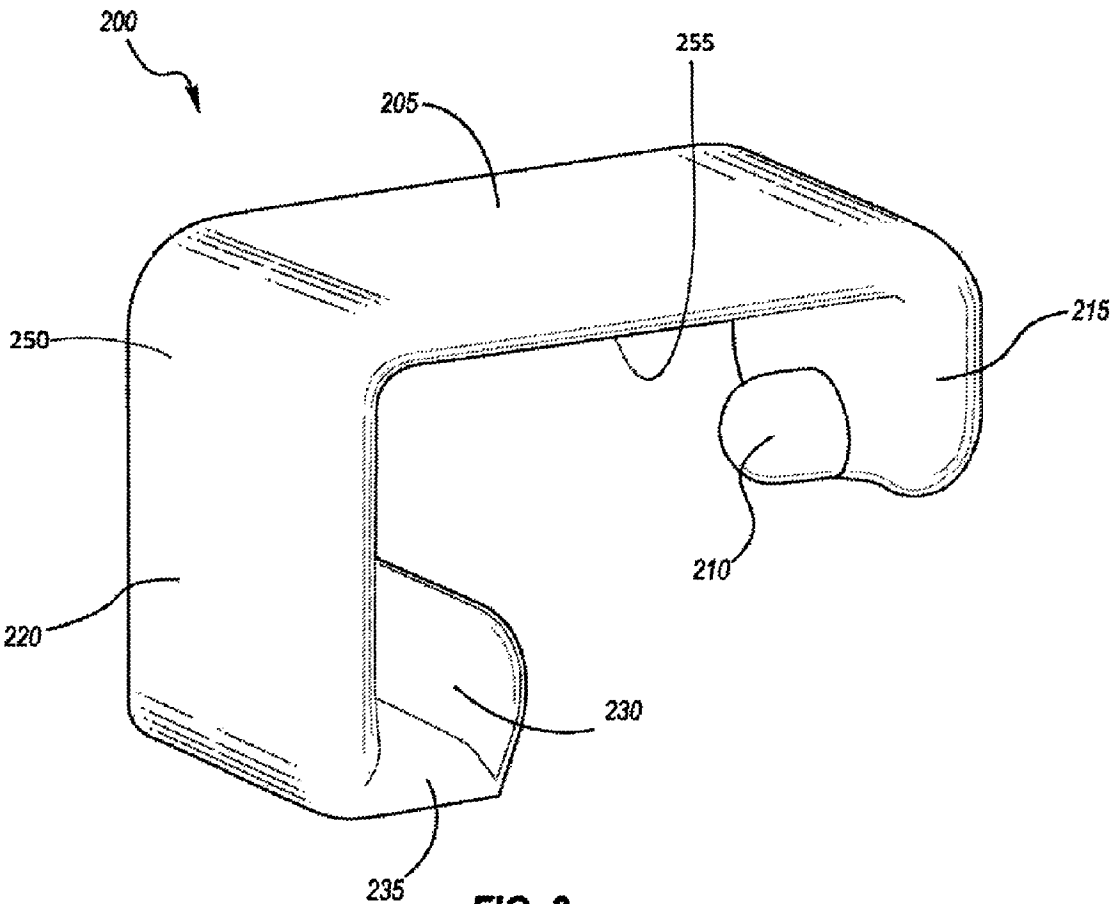
FIG. 2 is a perspective view of a removable element.

FIG. 2 illustrates a perspective view of a removable element 200 configured to removably couple to a license plate frame 100. In a particular implementation of a customized license plate system or apparatus, at least one removable element 200 is removably coupled to a license plate frame 100. The removable element 200 may comprise an ornamental or decorative removable element. In some implementations, the removable element 200 may comprise an alphabet letter, symbol, logo, character, picture, shape, and the like on the face of the removable element. A plurality of removable elements 200 may be coupled to the license plate frame to spell a word or create a pattern.

The removable element may comprise multiple elements coupled together or a single element bent to form a head 215, a body 205 coupled to the head 215, and a base 220 coupled to the body. In an implementation, the body 205 is substantially perpendicular to the head 215 and the base 220, the head 215 and the base 220 being opposite each other and substantially parallel. In other implementations, the head 215, body 205, and base 220 may be angled relative to another at any angle that allows the removable element to hold at least a portion of the inner frame edge 115, outer frame edge 110, and front side 125 of the license plate frame 100 within the boundaries formed by the head 215, body 205, and base 220. For example, implementations are contemplated wherein the head 215 comprises a curved portion extending between the body 205 and the pin 210.

In a particular implementation viewed as a whole and from the side, the removable element 200 may comprise an angular C-shaped element (or angular G-shaped element if the channel is included). Accordingly, a removable element 200 may further comprise a inside surface along the interior facing surfaces of the head 215, body 205, and base 220, and an outside surface along the exterior facing surfaces of the head 215, body 205, and base 220. As will be shown in FIGS. 3-5, when coupled to a license plate frame 100, the head 215 of the removable element 200 is proximate the inner frame edge 115 of a license plate frame 100, the base 220 of the removable element 200 is proximate the outer frame edge 110, and the body 205 covers at least a portion of the front side 125 of the license plate frame 100.

Various implementations of the removable element 200 may comprise a pin 210 protruding from or coupled to an inside surface of the head 215 of the removable element 200. The pin 210 may be configured or sized such that at least a portion of the pin 210 fits within a notch 140 on the license plate frame. In the implementation illustrated in FIG. 2, the pin 210 is substantially cylindrical in shape with a rounded tip. In other implementations, the pin 210 may comprise any three-dimensional shape that will fit within, engage, or otherwise mate with at least one of the notches 130 on the license plate frame.

An implementation of the removable element 200 may further comprise a channel 230 proximate the base 220 of the removable element. The channel 230 may be configured to hold a portion of the outer edge 110 of the license plate frame 100 within the channel 230. In the implementation shown in FIG. 2, the channel 230 comprises a three-walled channel 230. The three walls of the channel may comprise an end wall, a second wall, and a base wall formed as part of the base 220 of the removable element 200. The second wall may extend substantially perpendicular from the base wall in a direction towards the head of the removable element. The end wall may extend from the second wall towards the body of the removable element. In other implementations, the channel may be comprise of rounded walls or elements, or any similar design that is configured to house at least a portion of the outer edge within the channel.

Viewed another way, a removable element 200 may comprise a L-shaped element, the L-shaped element comprised of the base 220 and the body 205. Position of the base 220 and body 205 form an outer surface 250 and an inner surface 255 of the L-shaped member. A first channel wall 235 is coupled to the base 220 on an end of the base 220 opposite the body 205 to form a channel 230 between the first channel wall 235 and the base 220. In such a configuration, the channel 230 is proximate the inside surface 255 of the L-shaped member formed by the body 205 and base 220 of the removable element 200.

Figure 3:
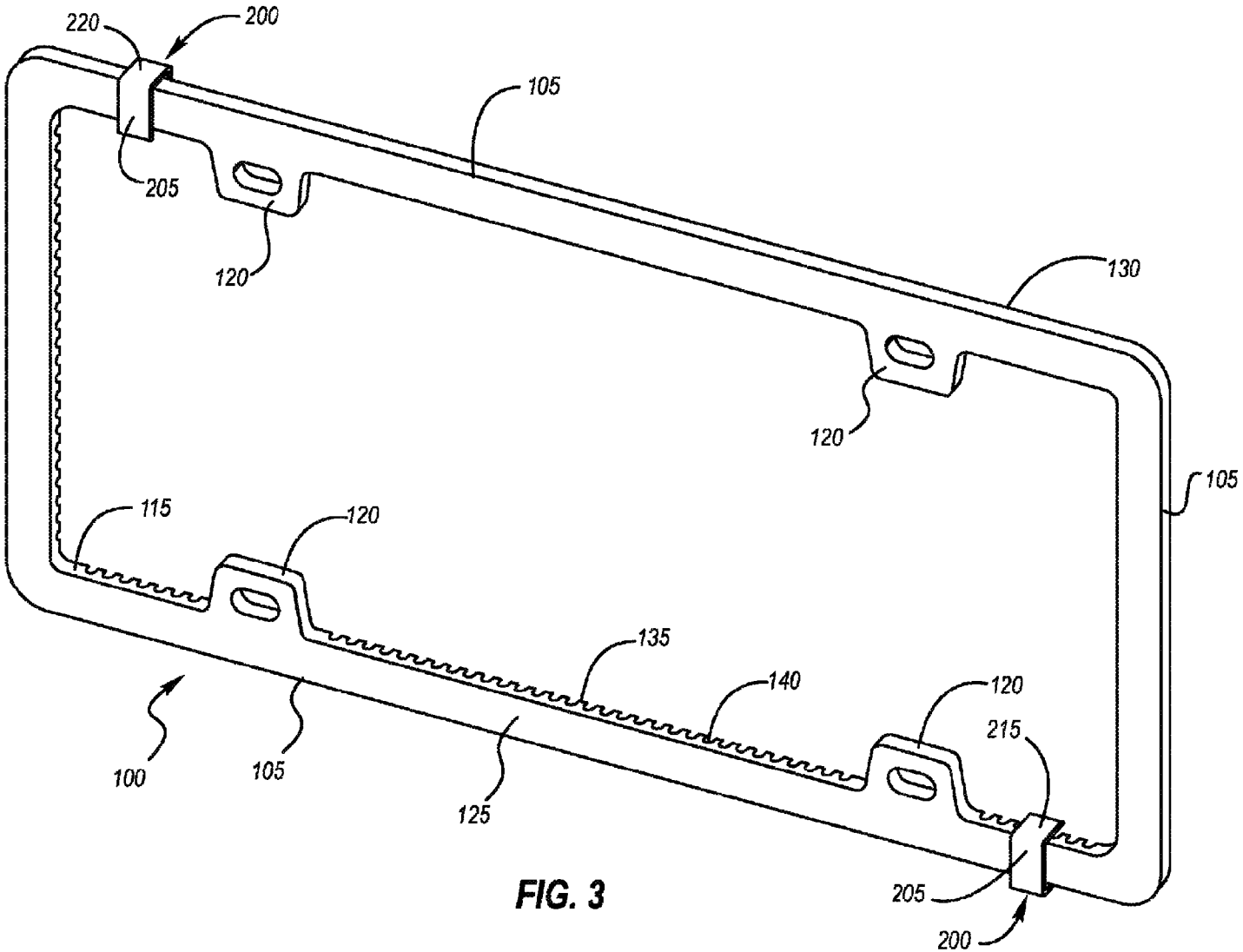
FIG. 3 is a front perspective view of a license plate frame with two removable elements removably coupled to the license plate frame.
Figure 4:
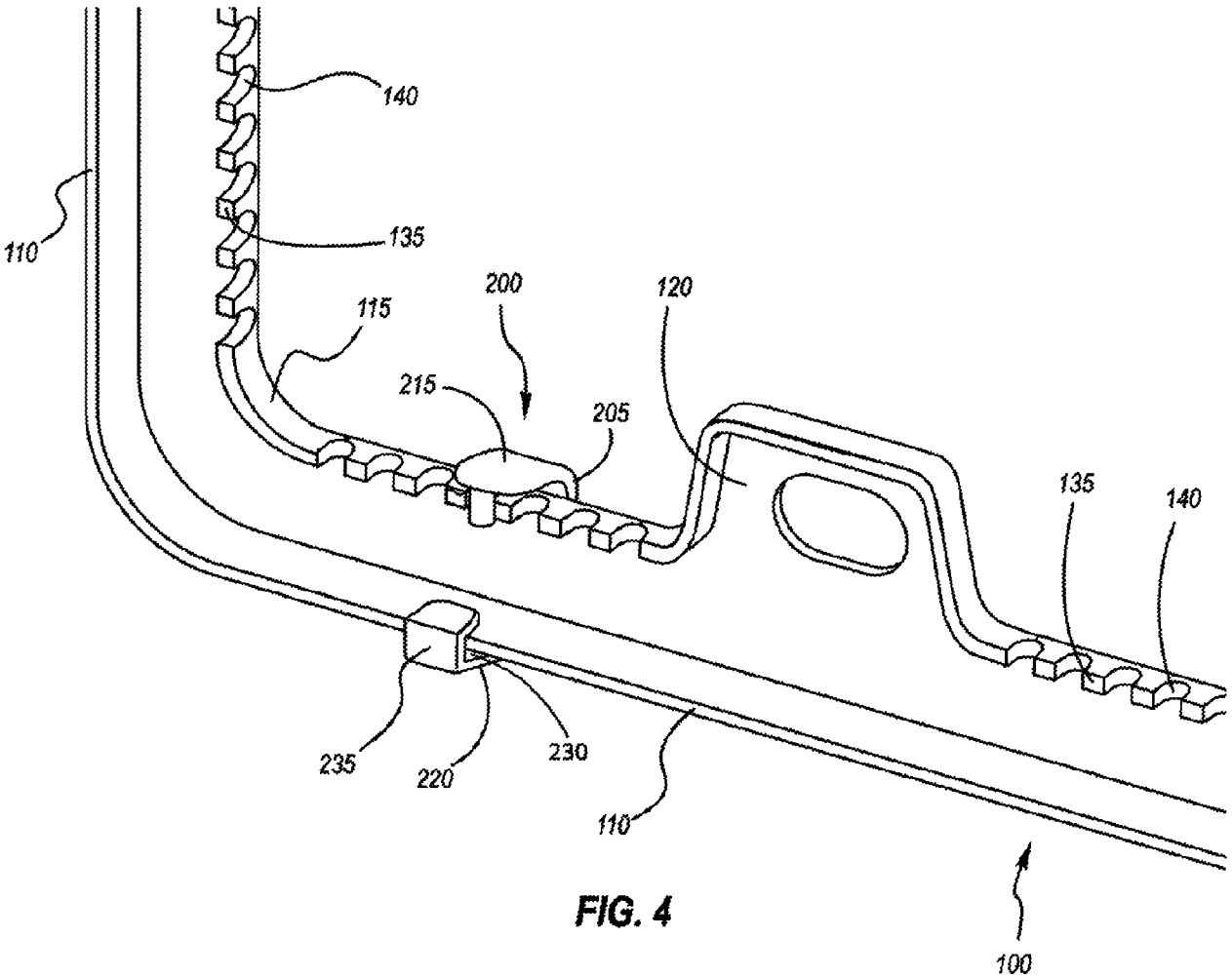
FIG. 4 is a partial rear perspective view of license plate frame with a removable element removable coupled to the license plate frame.

FIG. 3 shows a front perspective view of a license plate frame 100 with two removable elements 200 removably coupled to the license plate frame 100. FIG. 4 illustrates a close up rear view of the removable element 200 coupled near the bottom right portion of the license plate frame 100 in FIG. 3.

As illustrated in FIG. 3, the face of the body 205 of removable element 200 coupled to a license plate frame 100 is visible when the license plate frame 100 is viewed from the front side 125. As previously noted, the face of the removable element may comprise a variety of ornamental designs or characters 300, (shown in FIG. 5) such as but not limited to at least one alphabet letter, symbol, logo, character, picture, shape, and anything that could be attached to a license plate frame with a clip. In other implementations, the outside of the base may comprise a design or character in addition to or in place of a design or character on the face of the removable element. While the implementation of FIG. 3 illustrates a single removable element 200 coupled to the top side wall and a single removable element coupled to the bottom side wall of the license plate frame 100, in other implementations any number of removable elements 200 may be coupled any of the four side walls of the license plate frame 100.

FIG. 4 is a partial rear perspective view of a license plate frame 100 with a removable element 200 coupled to the bottom side wall of a license plate frame 100. As shown in FIG. 4, when the removable element 200 is coupled to the license plate frame 100, the pin 210 is engaged with a notch 140 on the inner frame edge 115 of the license plate frame 100. The outer frame edge 110 of the license plate frame 100 is likewise engaged with removable element 200 at the channel 230. When engaged, at least a portion of the outer frame edge 110 is typically within the boundaries of the channel 230.

The removable element 200, in a particular implementation, is comprised of a material, such as plastic or metal, flexible enough that a user may couple and uncouple the removable element to the license plate frame. To removably couple the removable element 200 to the license plate frame, a user may slide the outer frame edge 110 of the frame 100 within the channel 230 of the removable element 200. A user may further bend or flex the removable element 200 such that the pin 210 slides over the inner frame edge 115 of license plate frame 100. A user may further direct the pin 210 into a particular notch 140 on the inner frame edge 115. A user may further slide the removable element 200 to other notches 140 by lifting pin 210 out of the notch 140, then sliding or directing the removable element 200 along the inner frame edge 115 to another notch 140.

Figure 5:
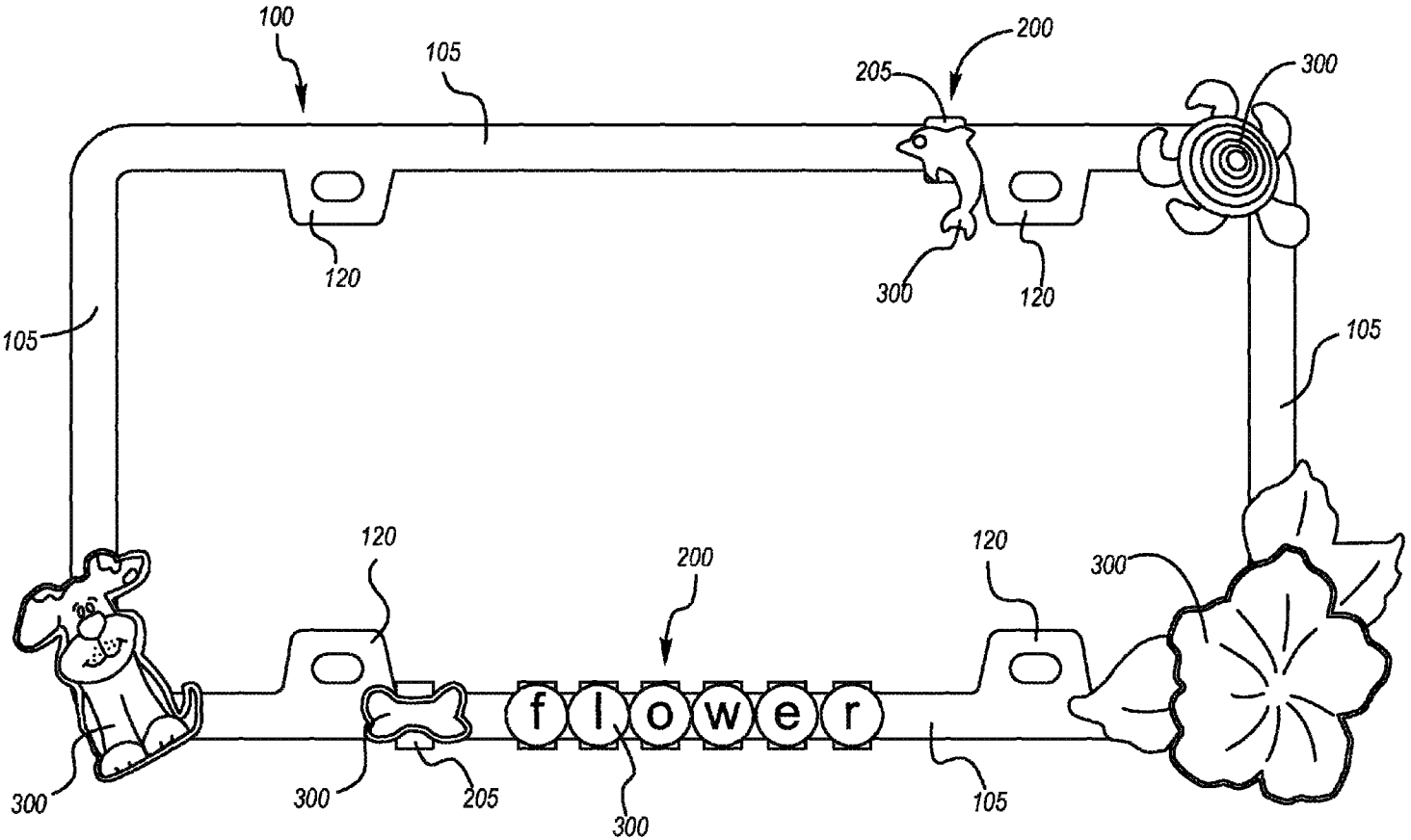
FIG. 5 is a front view of a license plate frame with ornamental removable elements removably coupled to the license plate frame.

FIG. 5 illustrates an embodiment of the license plate frame with a plurality of removable elements 200 removably coupled to the frame. FIG. 5 illustrates a front view this implementation. As shown, a plurality of removable elements 200 may be removably coupled to the license plate frame 100 at various points. Furthermore, the removable elements 200 may comprise a variety of ornamental elements 300 or coverings such as letters, shapes, characters, flowers, animals, objects, etc. Here, there is one removable element 200 for each of the following ornamental elements 300: the dolphin, the turtle, the dog, the bone, each of the letters spelling F-L-O-W-E-R, the flower next to the word F-L-O-W-E-R, and the hibiscus flower on the corner. In other implementations, a removable element 200 may comprise a body 205 sized to allow for a plurality of ornamental elements 300 to be coupled to the removable element 200.

It will be understood that implementations are not limited to the specific components disclosed herein, as virtually any components consistent with the intended operation of a method and/or system implementation for removable elements on a license plate frame may be utilized. Accordingly, for example, although particular notches, frames, and removable elements may be disclosed, such components may comprise any shape, size, style, type, model, version, class, grade, measurement, concentration, material, weight, quantity, and/or the like consistent with the intended operation of a method and/or system implementation for a license plate frame with removable elements may be used.

In places where the description above refers to particular implementations of license plate frames and removable elements it should be readily apparent that a number of modifications may be made without departing from the spirit thereof and that these implementations may be applied to other license plate frames and removable elements. The accompanying claims are intended to cover such modifications as would fall within the true spirit and scope of the disclosure set forth in this document. The presently disclosed implementations are, therefore, to be considered in all respects as illustrative and not restrictive, the scope of the disclosure being indicated by the appended claims rather than the foregoing description. All changes that come within the meaning of and range of equivalency of the claims are intended to be embraced therein.

The invention claimed is:

1. A license plate frame, comprising:

four borders surrounding a license plate opening, the four borders comprising a front side and a rear side opposite the front side;

an outer frame lip extending outwardly from the rear side of at least one of the four borders;

an inner frame lip extending outwardly from the rear side of at least one of the four borders, the inner frame lip comprising a plurality of equally sized notches adjacent each other within the inner frame lip, each notch sized to fit a pin of a removable element within the notch; and at least one removable element removably coupled to one of the four borders, the removable element comprising:

an L-shaped element comprising a base member coupled to a body member to form an outer surface that covers a portion of the front side of the one of the four borders and an inner surface on the L-shaped member;

a channel wall coupled to the base member on an end of the base member opposite the body member to form a channel that houses the outer frame lip of the one of the four borders between the channel wall and the base member, the channel proximate the inside surface of the L-shaped member; and a pin element coupled to the inside surface of the body member and located within one of the plurality of notches.

2. The license plate frame of claim 1, wherein the inner frame lip extending outwardly from the at least one of the four borders comprises an inner frame lip extending outwardly from at least two opposing borders of the four borders, and wherein the outer frame lip extending outwardly from the at least one of four borders comprises an outer frame lip extending outwardly from at least two opposing borders of the four borders.

3. The license plate frame of claim 2, wherein the inner frame lip extending outwardly from at least two opposing borders of the four borders comprises an inner frame lip extending outwardly from each of the four borders, and wherein the outer frame lip extending outwardly from at least two opposing border of the four borders comprises an outer frame lip extending outwardly from each of the four borders.

4. The license plate frame of claim 3, wherein the inner frame lip and the outer frame lip extend outward substantially perpendicular from the rear side of the borders.

5. The license plate frame of claim 4, wherein the inner frame lip extends from the four borders at an inner border of the four borders and the outer frame lip extends from the four borders at an outer border of the four borders.

6. The license plate frame of claim 5, wherein the plurality of notches comprise a plurality of rounded U-shaped notches.

7. The license plate frame of claim 5, wherein the plurality of notches comprise a plurality of V-shaped notches.

8. The removable element of claim 5, wherein the pin element is coupled to an inner surface of a head member coupled to the inner surface of the body member, wherein the head member is substantially parallel to the base member and the pin element is substantially parallel to the body member.

9. The removable element of claim 8, wherein the body member extends beyond at least one of the base member and the head member.

10. The removable element of claim 9, further comprising an ornamental element coupled to the outer surface of the body member.

11. A license plate frame, comprising:

a top border member comprising a front side, a rear side opposite the front side, and two screw mounts;

a bottom border member comprising a front side, a rear side opposite the front side, and two screw mounts;

an outer frame lip extending outwardly from the rear side of each of the top and bottom border members;

an inner frame lip extending outwardly from the rear side of each of the top and bottom border members, the inner frame lip comprising a plurality of equally sized notches adjacent each other within the inner frame lip, each notch sized to fit a pin of a removable element within the notch; and at least one removable element removably coupled one of the top and bottom border members, the removable element comprising a pin protruding from a head member and engaged with one of the plurality of notches, a body member coupled to the head member, and a base member coupled to the body member, the base member comprising a channel slidably engaged with the outer frame lip.

12. The license plate frame of claim 11, further comprising two side border members coupled to the top and bottom border members between the top and bottom border members, each side border member comprising an outer frame lip extending outwardly from the rear side of each of the top and bottom border members and an inner frame lip extending outwardly from the rear side of each of the top and bottom border members, the inner frame lip of each side border member comprising a plurality of equally sized notches adjacent each other within the inner frame lip, each notch sized to fit a pin of a removable element within the notch.

13. The license plate frame of claim 12, further comprising an ornamental element coupled to an outer surface of the body member.

* * * * *